US011260682B2

(12) United States Patent
Katagami

(10) Patent No.: US 11,260,682 B2
(45) Date of Patent: Mar. 1, 2022

(54) PRINTING APPARATUS

(71) Applicant: SEIKO EPSON CORPORATION, Tokyo (JP)

(72) Inventor: Satoru Katagami, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/883,533

(22) Filed: May 26, 2020

(65) Prior Publication Data

US 2020/0376863 A1 Dec. 3, 2020

(30) Foreign Application Priority Data

May 27, 2019 (JP) ..... JP2019-098348

(51) Int. Cl.

| | |
|---|---|
| ***B41J 15/04*** | (2006.01) |
| ***B41J 2/01*** | (2006.01) |
| ***B41J 13/02*** | (2006.01) |
| ***B41J 11/00*** | (2006.01) |

(52) U.S. Cl.

CPC ..... *B41J 15/048* (2013.01); *B41J 2/01* (2013.01); *B41J 11/002* (2013.01); *B41J 11/007* (2013.01); *B41J 13/02* (2013.01)

(58) Field of Classification Search

CPC ..... G03G 13/20; G03G 15/20; B41J 15/048; B41J 2/01; B41J 13/02; B41J 11/007; B41J 11/002; B41J 15/165; B41J 11/0024

See application file for complete search history.

(56) References Cited

U.S. PATENT DOCUMENTS

| | | | | |
|---|---|---|---|---|
| 5,896,154 | A * | 4/1999 | Mitani | B41J 2/14129 347/102 |
| 5,966,145 | A * | 10/1999 | Miura | B41J 2/1721 347/33 |
| 10,618,317 | B2 * | 4/2020 | Katagami | B41J 11/00222 |
| 2002/0168210 | A1 * | 11/2002 | Verhoest | B41J 29/023 400/578 |
| 2006/0125901 | A1 * | 6/2006 | Verhoest | B41J 29/023 347/104 |
| 2008/0026208 | A1 * | 1/2008 | Katabami | G03G 15/2057 428/336 |
| 2018/0229512 | A1 | 8/2018 | Katagami | |

FOREIGN PATENT DOCUMENTS

| | | |
|---|---|---|
| JP | 2016-087926 | 5/2016 |
| JP | 2018-130901 | 8/2018 |

* cited by examiner

*Primary Examiner* — Huan H Tran
(74) *Attorney, Agent, or Firm* — Workman Nydegger

(57) ABSTRACT

A printing apparatus including a set section on which a printing medium is set, a winding unit configured to wind, the printing medium transported from the set section, a head configured to discharge an ink onto an image forming surface of the printing medium being transported, thereby forming an image, and a drying chamber formed downstream of the head in a transport direction and downward of the head, the drying chamber being configured to dry the ink discharged to the printing medium, wherein the drying chamber is provided with an endless belt made of metal and configured to transport the printing medium while being in contact with an image non-forming surface on an opposite side of the printing medium from the image forming surface, and a plurality of rollers over which the endless belt is stretched, the plurality of rollers being configured to cause the endless belt to rotate.

7 Claims, 3 Drawing Sheets

PRINTING APPARATUS

The present application is based on, and claims priority from JP Application Serial Number 2019-098348, filed May 27, 2019, the present disclosure of which is hereby incorporated by reference herein in its entirety.

BACKGROUND

1. Technical Field

The disclosure relates to a printing apparatus.

2. Related Art

In the related art, there has been used a printing apparatus configured to discharge an ink to a printing medium to form an image. Such printing apparatuses include a printing apparatus provided with a drying chamber for drying the ink discharged to the printing medium. For example, JP 2016-87926 A discloses a printing apparatus configured to discharge an ink to a printing medium to form an image, the printing apparatus including a drying unit as a drying chamber for drying the ink discharged to the printing medium.

There are various types of printing media processed in the printing apparatus, and there are some printing media having different types of materials between an image forming surface of the printing medium and an image non-forming surface on the opposite side of the image forming surface. For example, there are printing media and the like, which have the image forming surface for which a resin such as polypropylene or vinyl chloride is used and the image non-forming surface for which a release paper such as glassine paper is used. For example, processing such printing media allows the ink discharged to the image forming surface as well as the moisture contained in the printing medium to volatilize, and the stretching properties become different from each other between the image forming surface and the image non-forming surface due to different types of materials between the image forming surface and the image non-forming surface, which may lead to the occurrence of wrinkles and the like on the printing medium.

Here, the printing apparatus in JP 2016-87926 A includes a rotating drum in the drying unit, and the image non-forming surface of the printing medium is brought into contact with the rotating drum to cause the ink discharged to the image forming surface in the drying unit to be dried, thus making it possible to suppress the volatilization of the moisture contained in the printing medium from the side of the image non-forming surface, and to suppress the occurrence of wrinkles and the like on the printing medium. However, the provision of the rotating drum in the drying chamber prevents the rotating drum from being configured to be thin, causing the drying chamber to increase in size and the printing apparatus to increase in size. In addition, the provision of a component different from the rotating drum, even when suppressing the volatilization of the moisture contained in the printing medium from the side of the image non-forming surface, causes the printing apparatus to increase in size depending on the arrangement of the drying chamber.

Thus, in the related art, it has been difficult to dry the ink while suppressing the occurrence of wrinkles on the printing medium without causing the printing apparatus to increase in size.

SUMMARY

A printing apparatus according to the present disclosure for resolving the above-described issue includes a set section on which a printing medium in a rolled form is set, a winding unit configured to wind, in a rolled form, the printing medium transported from the set section, a head configured to discharge an ink onto an image forming surface of the printing medium being transported, thereby forming an image, and a drying chamber formed downstream of the head in a transport direction of the printing medium and downward of the head in a gravitational direction, the drying chamber being configured to dry the ink discharged onto the printing medium, in which the drying chamber is provided with an endless belt made of metal and configured to transport the printing medium while being in contact with an image non-forming surface on an opposite side of the printing medium from the image forming surface, and a plurality of rollers over which the endless belt is stretched, the plurality of rollers being configured to cause the endless belt to rotate.

DESCRIPTION OF EXEMPLARY EMBODIMENTS

Figure 1:
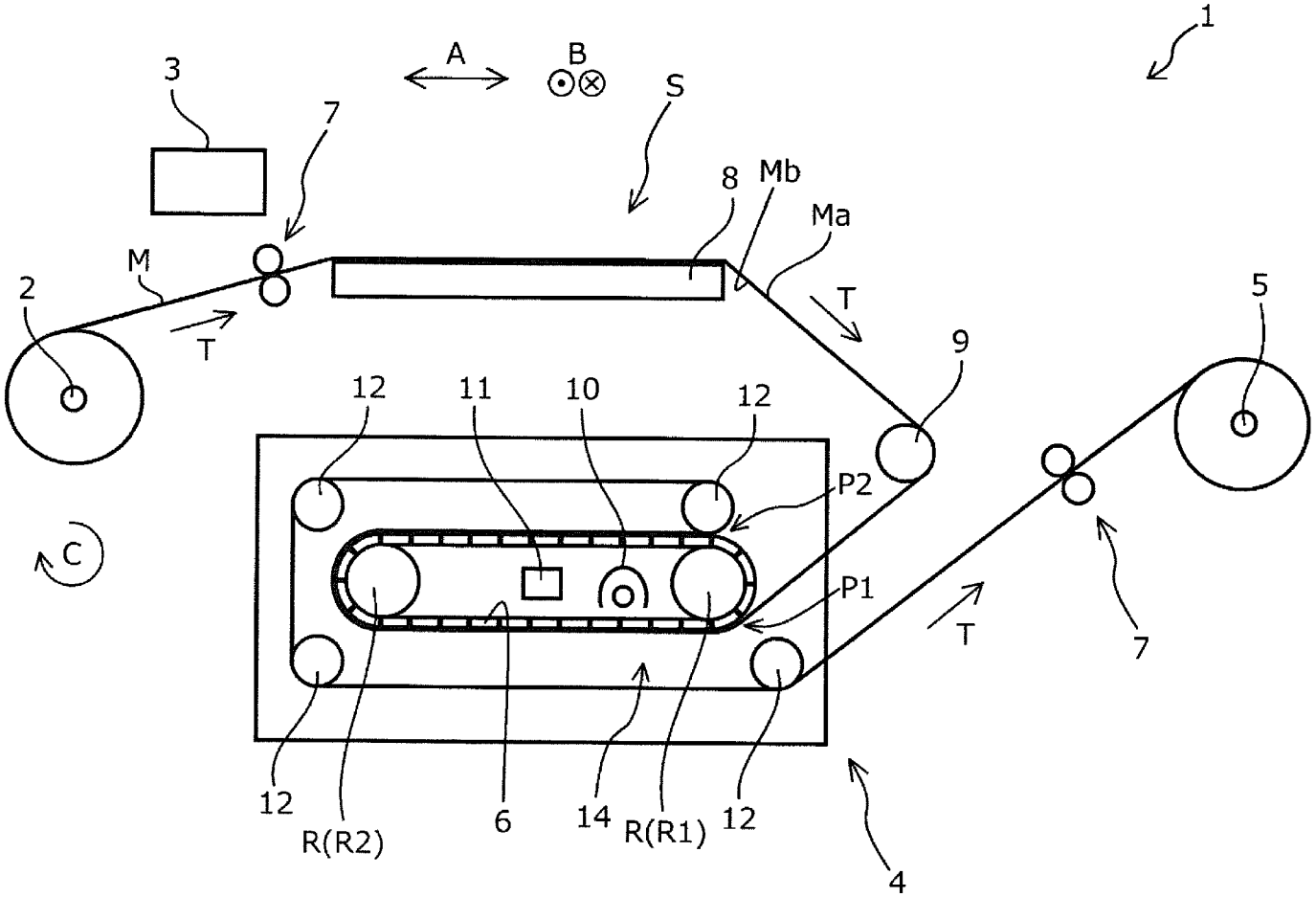
FIG. 1 is a side view schematically illustrating a printing apparatus according to Example 1 of the present disclosure.

First, the present disclosure will be schematically described.

A printing apparatus according to a first aspect of the present disclosure for resolving the above-described issue includes a set section on which a printing medium in a rolled form is set, a winding unit configured to wind, in a rolled form, the printing medium transported from the set section, a head configured to discharge an ink onto an image forming surface of the printing medium being transported, thereby forming an image, and a drying chamber formed downstream of the head in a transport direction of the printing medium and downward of the head in a gravitational direction, the drying chamber being configured to dry the ink discharged onto the printing medium, in which the drying chamber is provided with an endless belt made of metal and configured to transport the printing medium while being in contact with an image non-forming surface on an opposite side of the printing medium from the image forming surface, and a plurality of rollers over which the endless belt is stretched, the plurality of rollers being configured to cause the endless belt to rotate.

According to the above aspect, the endless belt formed of metal configured to transport the printing medium while being in contact with the image non-forming surface is provided in the drying chamber, making it possible to suppress the volatilization of the moisture contained in the printing medium from the side of the image non-forming surface, and to suppress the occurrence of wrinkles and the like on the printing medium.um can be suppressed. In addition, the endless belt, which is formed of metal, makes it possible to reduce the size, and to suppress the drying chamber from increasing in size. Further, the formation of the drying chamber downward of the head in the gravitational direction achieves efficient arrangement inside the printing apparatus, making it possible to suppress the printing apparatus from increasing in size. That is, this makes it possible to dry the ink while suppressing the occurrence of wrinkles on the printing medium without causing the printing apparatus to increase in size.

A printing apparatus according to a second aspect of the present disclosure is the printing apparatus, according to the first aspect, in which the roller is provided in plurality, which can be at least three rollers, the rollers are arranged such that the endless belt includes a portion that is convex with respect to two of the rollers when viewed from a rotation axis direction of the rollers, and the endless belt is configured to transport the printing medium while being in contact with the image non-forming surface, with the endless belt including the portion that is convex.

According to the above aspect, the endless belt transports the printing medium while being in contact with, including the portion being convex, the image non-forming surface, allowing the printing medium to reliably come in contact with the endless belt, and resulting in the enhancement of the transport accuracy.

A printing apparatus according to a third aspect of the present disclosure is the printing apparatus in the first or second aspect, in which the endless belt includes a suction hole.

According to the above aspect, the endless belt, which includes a suction hole, allows the printing medium to reliably come in contact with the endless belt, resulting in the enhancement of the transport accuracy.

A printing apparatus according to a fourth aspect of the present disclosure is the printing apparatus according to any one of the first to third aspects, including a dancer roller provided between the head and the drying chamber in the transport direction of the printing medium, the dancer roller being configured to change a position thereof while being in contact with the image non-forming surface.

According to the above aspect, the dancer roller configured to change its position while being in contact with the image non-forming surface is provided between the head and the drying chamber, allowing the transport speed in a printing region facing the head that discharges an ink to perform printing to differ from the transport speed within the drying chamber, and to make the staying time of the printing medium within the drying chamber constant, and the like, for example.

A printing apparatus according to a fifth aspect of the present disclosure is the printing apparatus according to any one of the first to fourth aspects, including a belt heater configured to heat the endless belt.

According to the above aspect, the belt heater configured to heat the endless belt is provided, allowing the endless belt to be at or above the temperature inside the drying chamber, and the ink discharged to the printing medium to be effectively dried, for example.

A printing apparatus according to a sixth aspect of the present disclosure is the printing apparatus according to the fifth aspect, in which the belt heater is configured to heat the endless belt from a side in contact with the roller.

According to the above aspect, the belt heater, which heats the endless belt from the side in contact with the roller, can be easily heated without being brought into contact with the printing medium.

A printing apparatus according to a seventh aspect of the present disclosure is the printing apparatus according to any one of the first to sixth aspects, in which the endless belt is disposed to be in a state of being in contact with the image non-forming surface, the contact beginning from a position facing a first roller among the rollers for the endless belt, via a position facing a roller other than the first roller among the rollers, to a position facing the first roller.

According to the above aspect, the endless belt is disposed to be in a state of being in contact with the image non-forming surface from the position facing the first roller among the rollers in the endless belt, via the position facing the roller other than the first roller among the rollers, to the position facing the first roller. That is, a large contact area is secured between the endless belt and the printing medium. This makes it possible to effectively dry the ink discharged to the printing medium.

Embodiments of the present disclosure will be described below with reference to the accompanying drawings.

Example 1

First, a printing apparatus 1 according to Example 1 of the present disclosure will be described with reference to FIGS. 1 and 2. Note that all of FIGS. 1 and 2, and FIG. 3 that will be described later, are schematic views, and are illustrated in a manner that some components are omitted, and the like.

The printing apparatus 1 according to the example is a printing apparatus configured to print an image on a printing medium M such as paper, cloth, film, or the like, which can process the printing medium M having different types of materials between an image forming surface Ma and an image non-forming surface Mb, such as the printing medium M in which a resin such as polypropylene, vinyl chloride, or the like is used for the image forming surface Ma, and a release paper such as glassine paper is used for the image non-forming surface Mb. In addition, the printing apparatus 1 according to the example is communicatively coupled to a non-illustrated computer that is an external device. Note that, as illustrated in FIG. 1, the printing apparatus 1 according to the example is configured to perform printing on the printing medium M wound in a rolled form.

As illustrated in FIG. 1, the printing apparatus 1 according to the example includes a set section 2, in which the printing medium M in a rolled form is set, configured to rotate in a rotation direction C to feed out the printing medium M. The printing apparatus 1 also includes a plurality of roller pairs 7 configured to transport the printing medium M, which has been fed out from the set section 2. The printing medium M is transported in a transport direction T by the roller pair 7 and the like inside the printing apparatus 1.

The printing medium M transported by the roller pair 7 and the like is printed by a head 3 in a printing region S. The printing region S is formed with a platen 8, where the printing apparatus 1 according to the example discharges an ink from the head 3 to the image forming surface Ma of the printing medium M, which is supported by the platen 8. As illustrated in FIG. 1, the head 3 has a standby position at a position separated from the printing region S, which faces the platen 8. Then, when the printing operation is started, the head 3 moves from the standby position to the printing region S, and discharges an ink to form an image on the image forming surface Ma of the printing medium M while moving in a direction A along the transport direction T of the printing medium M over the platen 8, and a direction B being the width direction of the printing medium M. Note that, while the ink is being discharged from the head 3 to form an image, the printing medium M stands still in the printing region S. Accordingly, the printing medium M is intermittently transported while repeating standing still and moving when the printing operation is performed.

The printing medium M on which the image is formed in the printing region S is transported to a drying chamber 4 via a state where the image non-forming surface Mb of the printing medium M is in contact with a dancer roller 9. Here, the image non-forming surface Mb is a surface on the opposite side of the image forming surface Ma in the printing medium M. The drying chamber 4 is formed with a drying promotion unit 14 in which an endless belt 6 formed of metal configured to transport the printing medium M while being in contact with the image non-forming surface Mb in the printing medium M, and a plurality of rollers R over which the endless belt 6 is stretched, the plurality of rollers R causing the endless belt 6 to rotate, are provided. The drying chamber 4 is also formed with a plurality of redirection rollers 12 that alter the transport direction T inside the drying chamber 4.

The printing apparatus 1 according to the example can transport the printing medium M at a constant speed inside the drying chamber 4 even when printing is performed. Specifically, the roller pair 7 downstream of the drying chamber 4 in the transport direction T drives at a constant speed, and the dancer roller 9 moves along the direction A in association with the standing still and moving of the printing medium M in the printing region S. The printing apparatus 1 according to the example, by the movement of the dancer roller 9 in this manner, adjusts, in units of long time, the difference in the transport speed of units of short time between the upstream and the downstream from the dancer roller 9 in the transport direction T. Transporting of the printing medium M at a constant speed inside the drying chamber 4 makes it possible to suppress the drying unevenness of the ink.

Figure 2:
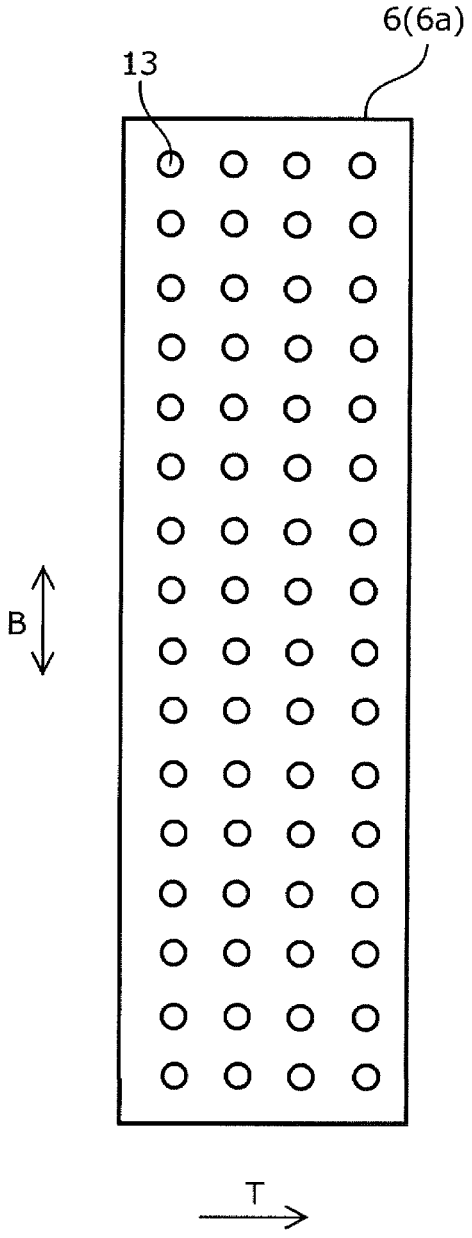
FIG. 2 is a plan view schematically illustrating a printing apparatus according to Example 1 of the present disclosure.

The endless belt 6 constituting the drying promotion unit 14 is configured by coupling of a plurality of flat plate members 6*a* in an approximately rectangular shape such as that illustrated in FIG. 2. In addition, as illustrated in FIG. 2, a plurality of suction holes 13 are formed through the flat plate member 6*a*. Further, as illustrated in FIG. 1, a suction unit 11 is formed in the drying promotion unit 14, where a configuration is provided in which the printing medium M supported by the endless belt 6 is suctioned through the suction holes 13 to be suctioned onto the flat plate member 6*a*.

The endless belt 6 is stretched between two rollers R of a first roller R1 and a second roller R2. Here, all of the two rollers R and the plurality of redirection rollers 12 are driven rollers. This allows the driven rollers to rotate in a driven manner, in accordance with the printing medium M transported in the transport direction T in association with the driving of the roller pair 7 downstream of the drying chamber 4 in the transport direction T. However, at least one of the two rollers R or the plurality of redirection rollers 12 may be a driving roller configured to rotate by a driving force from a motor or the like.

In addition, the drying promotion unit 14 includes a belt heater 10 configured to directly heat the endless belt 6. This provides a configuration in which the temperature of the endless belt 6 is higher than the temperature of the interior of the drying chamber 4.

Note that in the printing apparatus 1 according to the example, the drying chamber 4 is provided downward of the printing region S in the gravitational direction, rather than that the printing region S and the drying chamber 4 are provided in a manner aligned side by side. The printing region S and the drying chamber 4, which are provided in a manner aligned side by side, prevent the region downward of the head 3 in the gravitational direction from being effectively utilized, making the printing apparatus tend to increase in size. However, the printing apparatus 1 according to the example, in which the drying chamber 4 is provided downward of the printing region S in the gravitational direction, effectively utilizes the region downward of the head 3 in the gravitational direction, suppressing the printing apparatus from increasing in size.

Further, the printing apparatus 1 according to the example includes a winding unit 5 configured to wind, in a rolled form, the printing medium M in an elongated form downstream of the drying chamber 4 in the transport direction T. Note that the printing apparatus 1 according to the example causes the set section 2 and the winding unit 5 to rotate in the rotation direction C using the printing medium wound such that the image forming surface Ma becomes the outer side, when winding the printing medium M in a rolled form such that the image forming surface Ma becomes the outer side. However, the printing apparatus 1 according to the example can cause the set section 2 and the winding unit 5 to rotate in the direction opposite to the rotation direction C using the printing medium wound such that the image forming surface Ma becomes the inner side, when winding the printing medium M in a rolled form such that the image forming surface Ma becomes the inner side.

Here, to once summarize, the printing apparatus 1 according to the example includes the set section 2 for setting of the printing medium M in a rolled form, the winding unit 5 configured to wind, in a rolled form, the printing medium M transported from the set section 2, the head 3 configured to discharge an ink to the image forming surface Ma of the printing medium M being transported to form an image, and the drying chamber 4 formed downstream of the head 3 in the transport direction T of the printing medium M and downward of the head 3 in the gravitational direction, the drying chamber 4 being configured to dry the ink discharged to the printing medium M. Further, the drying chamber 4 is provided with the endless belt 6 formed of metal configured to transport the printing medium M while being in contact with the image non-forming surface Mb, and a plurality of rollers R over which the endless belt is stretched, the plurality of rollers R causing the endless belt 6 to rotate.

The printing apparatus 1 according to the example, which includes the endless belt 6 formed of metal configured to transport the printing medium M while being in contact with the image non-forming surface Mb, makes it possible suppress the volatilization of the moisture contained in the printing medium M from the side of the image non-forming surface Mb, and to suppress the occurrence of wrinkles and the like on the printing medium M. In addition, the use of the endless belt 6 formed of metal as a component of the drying promotion unit 14 achieves the reduction in size, suppressing the drying chamber 4 from increasing in size. Further, the drying chamber 4 is formed downward of the head 3 in the gravitational direction to achieve efficient arrangement inside the printing apparatus, suppressing the printing apparatus from increasing in size. That is, the printing apparatus 1 according to the example is configured to dry the ink while suppressing the occurrence of wrinkles on the printing medium M without an increase in size. Note that "downward of the head 3 in the gravitational direction" refers to downward in the gravitational direction of at least one of the standby position of the head 3 or the printing region S by the head 3.

In addition, as described above, the endless belt 6 according to the example, which includes the suction holes 13, allows the printing medium M to reliably come in contact with the endless belt 6, resulting in the enhancement of the transport accuracy.

In addition, as described above, the printing apparatus 1 according to the example includes the dancer roller 9 between the head 3 and the drying chamber 4 in the transport direction T. Further, as described above, the dancer roller 9 is configured to change its position while being in contact with the image non-forming surface Mb. Accordingly, the printing apparatus 1 according to the example allows the transport speed in the printing region S facing the head 3 that discharges an ink to perform printing to differ from the transport speed within the drying chamber 4, and to make the staying time of the printing medium M within the drying chamber 4 constant.

Further, as illustrated in FIG. 1, in the printing apparatus 1 according to the example, the endless belt 6 is disposed to be in a state of being in contact with the image non-forming surface Mb from a position P1 facing the first roller R1, via a position facing the second roller R2 that is a roller other than the first roller R1 among the plurality of rollers R, to a position P2 facing the first roller R1. That is, in the printing apparatus 1 according to the example, a large contact area is secured between the endless belt 6 and the printing medium M. Accordingly, the printing apparatus 1 according to the example makes it possible to effectively dry the ink discharged to the printing medium M.

Further, as described above, the printing apparatus 1 according to the example includes the belt heater 10 configured to heat the endless belt 6. Accordingly, the printing apparatus 1 according to the example is configured to cause the endless belt 6 to be at or above the temperature within the drying chamber 4, making it possible to effectively dry the ink discharged to the printing medium M. Note that the belt heater 10 according to the example is a halogen heater, however, the configuration of the belt heater 10 is not particularly limited, and a sheet-shaped heater or the like may be used for the belt heater 10, for example.

Note that the belt heater 10 is configured to heat the endless belt 6 from the interior of the drying promotion unit 14, that is, from the side in contact with the roller R. Heating the endless belt 6 by the belt heater 10 from the side in contact with the roller R in this way makes it possible to easily heat the endless belt 6 without being brought into contact with the printing medium M. However, the belt heater 10 may be configured to heat the endless belt 6 from the outside at a position at which the endless belt 6 is not in contact with the printing medium M. For example, in FIG. 1, the printing medium M does not come in contact with the belt heater 10 at a position from the position P2 to the position P1 in the rotation direction C in FIG. 1, thus, the belt heater 10 may be configured to heat the endless belt 6 from the outside at the position.

Example 2

Figure 3:
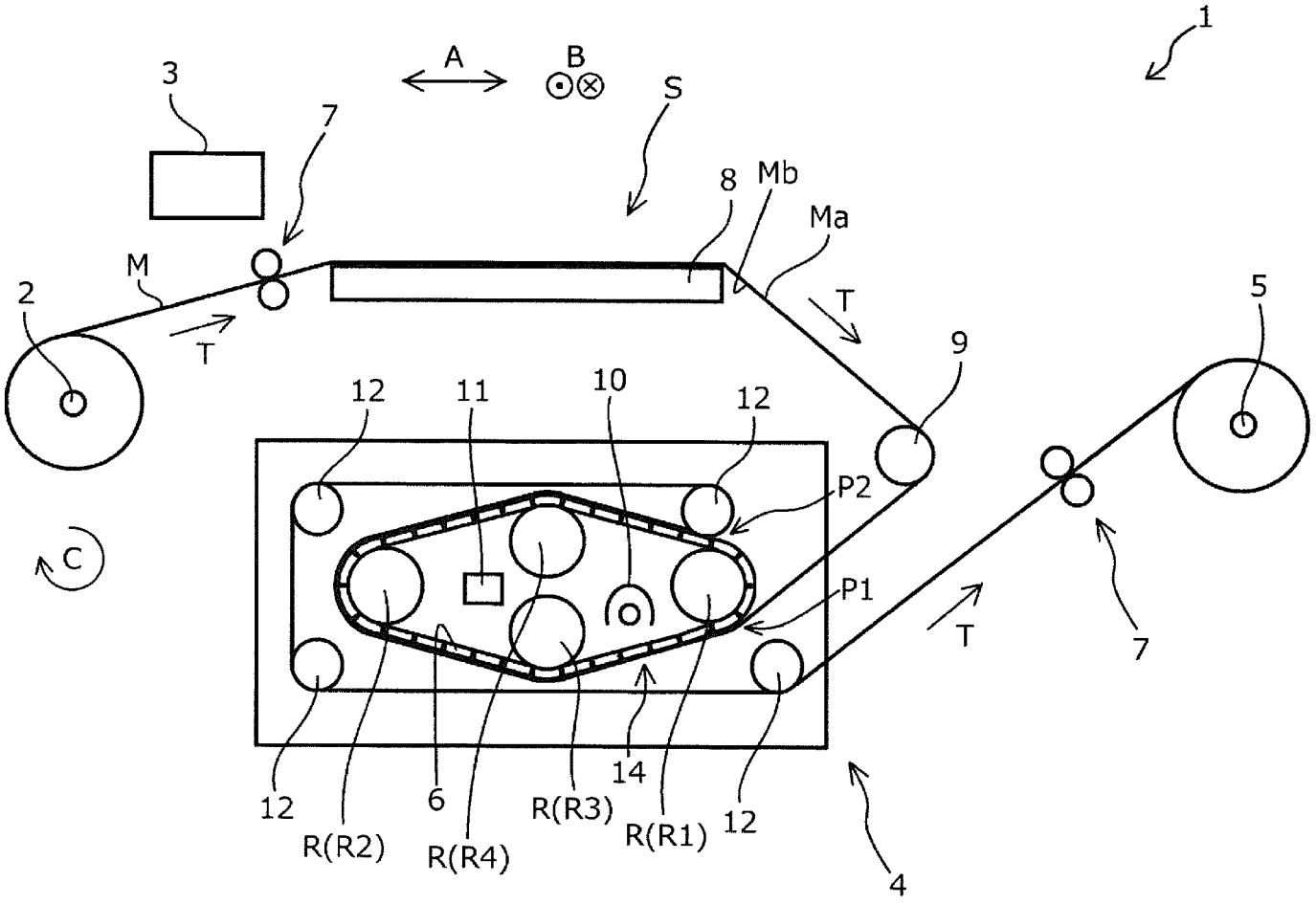
FIG. 3 is a side view schematically illustrating a printing apparatus according to Example 2 of the present disclosure.

Next, the printing apparatus 1 according to Example 2 of the present disclosure will be described with reference to FIG. 3. FIG. 3 is a view corresponding to FIG. 1 in the printing apparatus 1 according to Example 1. Here, the printing apparatus 1 according to the example has a configuration similar to that of the printing apparatus 1 according to Example 1 except for the configuration of the drying promotion unit 14. Accordingly, description of the portions having the common configuration will be omitted. Note that the constituent members common to those in the above-described Example 1 are denoted by the same reference signs, and the detailed description thereof will be omitted.

The drying promotion unit 14 in the printing apparatus 1 according to Example 1 includes the two rollers R constituted by the first roller R1 and the second roller R2, and the endless belt 6 stretched between the two rollers R. On the other hand, the printing apparatus 1 according to the example includes, in addition to the first roller R1 and the second roller R2, a third roller R3 and a fourth roller R4, where the endless belt 6 is stretched between the four rollers R of the first roller R1, the second roller R2, the third roller R3, and the fourth roller R4.

As illustrated in FIG. 3, the first roller R1 and the second roller R2 in the printing apparatus 1 according to the example are aligned in an approximately horizontal direction along the direction A, as in the first roller R1 and the second roller R2 in the printing apparatus 1 according to Example 1. Further, the third roller R3 and the fourth roller R4 in the printing apparatus 1 according to the example are aligned in an approximately vertical direction at a position of the approximately center of the first roller R1 and the second roller R2 in the direction A. That is, the four rollers R are arranged in this manner, thus, the endless belt 6 is disposed to include a portion being convex in the vertical direction.

As such, a configuration is favorably provided, in which three or more rollers R are provided, where the rollers R are arranged such that the endless belt 6 includes a portion being convex with respect to the first roller R1 and the second roller R2 that are two rollers R among the rollers R when viewed from the direction along the direction B being the rotation axis direction of the rollers R, and the endless belt 6 is configured to transport the printing medium M while being in contact with, including the portion being convex, the image non-forming surface Mb. This is because such a configuration makes it possible to cause the printing medium M to reliably come in contact with the endless belt 6, resulting in the enhancement of the transport accuracy. Note that the printing apparatus 1 according to the example includes four rollers R, and may include three rollers R, or five or more rollers R.

Note that the present disclosure is not limited to the aforementioned examples, and many variations are possible within the scope of the present disclosure as described in the appended claims. It goes without saying that such variations also fall within the scope of the present disclosure.

What is claimed is:

1. A printing apparatus comprising:

a set section on which a printing medium in a rolled form is set, a winding unit configured to wind, in a rolled form, the printing medium transported from the set section, a head configured to discharge an ink onto an image forming surface of the printing medium being transported, thereby forming an image, and a drying chamber formed downstream of the head in a transport direction of the printing medium and downward of the head in a gravitational direction, the drying chamber being configured to dry the ink discharged onto the printing medium, wherein the drying chamber is provided with a housing that surrounds an endless belt made of metal and configured to transport the printing medium while being in contact with an image non-forming surface on an opposite side of the printing medium from the image forming surface, and a plurality of rollers over which the endless belt is stretched, the plurality of rollers being configured to cause the endless belt to rotate.

2. The printing apparatus according to claim 1, comprising three or more of the rollers, wherein the rollers are arranged such that the endless belt includes a portion that is convex with respect to two of the rollers when viewed from a rotation axis direction of the rollers, and the endless belt is configured to transport the printing medium while being in contact with the image non-forming surface, with the endless belt including the portion that is convex.

3. The printing apparatus according to claim 1, wherein the endless belt includes a suction hole.

4. The printing apparatus according to claim 1, comprising a dancer roller provided between the head and the drying chamber in the transport direction of the printing medium, the dancer roller being configured to change a position thereof while being in contact with the image non-forming surface.

5. The printing apparatus according to claim 1, comprising a belt heater configured to heat the endless belt.

6. The printing apparatus according to claim 5, wherein the belt heater is configured to heat the endless belt from a side in contact with the roller.

7. The printing apparatus according to claim 1, wherein the endless belt is disposed to be in a state of being in contact with the image non-forming surface, the contact beginning from a position facing a first roller among the rollers for the endless belt, via a position facing a roller other than the first roller among the rollers, to a position facing the first roller.

* * * * *